United States Patent [19]

Musto et al.

[11] Patent Number: 4,640,464

[45] Date of Patent: Feb. 3, 1987

[54] ROLLER MILL CONTROL SYSTEM

[75] Inventors: Richard L. Musto, Homewood; Mark R. Dunn, Wilmette, both of Ill.

[73] Assignee: Combustion Engineering, Inc., Windsor, Conn.

[21] Appl. No.: 669,145

[22] Filed: Nov. 7, 1984

[51] Int. Cl.[4] ..... B02C 25/00

[52] U.S. Cl. ..... 241/34; 241/36; 241/119; 241/130

[58] Field of Search ..... 241/129, 130, 33–36, 241/117–121

[56] References Cited

U.S. PATENT DOCUMENTS 4,184,640 1/1980 Williams ..... 241/34

4,225,091 9/1980 Steier ..... 241/34 X

*Primary Examiner*—Mark Rosenbaum

*Attorney, Agent, or Firm*—Arthur E. Fournier, Jr.

[57] ABSTRACT

A control system (44, 112) particularly adapted to be cooperatively associated with a mill (10) and in particular a roller mill (10) of the type that is operative to effectuate the grinding and/or pulverization of solid materials. When so employed, the subject control system (44, 112) enables the roller mill (10) to be operated over a wide range of varying levels of output of pulverized material, while yet ensuring that both the proper air/solids ratio and the desired degree of fineness of the pulverized material are being maintained. To achieve this result, the subject control system (44, 112) is operatively connected in circuit relation with the feed means (12) that supplies to the roller mill (10) the material that is to be pulverized therein, with the drive means (20, 22) through which the mill (10) is driven, with the classifier means (38) that effects a separation of the pulverized material according to fineness, and with the means which receives the output from the roller mill (10).

6 Claims, 3 Drawing Figures

ROLLER MILL CONTROL SYSTEM

BACKGROUND OF THE INVENTION

This invention relates to control systems, and more specifically to an electronic control system that is capable of being cooperatively associated with a roller mill for purposes of controlling the rate of feed of material to the mill in accordance with the output being demanded from the mill, while yet at the same time ensuring that during changes in the output being demanded from the mill both a constant fineness of pulverized material and a constant air-to-solids ratio from the mill are maintained.

There has long existed a need to effectuate the grinding, i.e., pulverization, of various kinds of materials. To this end, there has been provided in the prior art an assortment of different types of apparatus, each alleged to be suitable for use for the purpose of accomplishing the grinding, i.e., pulverization, of one kind of material or another. One such type of apparatus, which has frequently been utilized for this purpose, is that commonly referred to by those in the industry as a roller mill. The basic operating principle of the roller mill is quite simple. Namely, in accord therewith material is reduced in size as a result of being ground by rolls running centrifugally against a stationary. outer ring.

Continuing, the mode of operation of the roller mill is such that the material, which is to be ground, is introduced into the mill at a controlled rate by feeder means, the latter being cooperatively associated with the mill. Upon entering the roller mill the material to be ground falls to the bottom of the mill. Thereafter, rotating plows which are set at an angle in front of the rolls cause the material to be scooped up in a continuous stream such that the material passes between the rolls and the grinding ring whereupon the material is pulverized through the coaction of the rollers and the ring.

In addition, a large volume of air enters into the roller mill through tangential ports suitably provided for this purpose in the base immediately under the grinding ring. This air serves to sweep the fine and medium fine fractions of the pulverized material into the separating zone. The latter zone is located directly above the grinding elements, i.e., the rolls and the grinding ring.

Within the separating zone, the ground material is classified by a separator. More specifically, as a consequence of this classification, oversize material is made to automatically drop back into the grinding zone whereupon it is subjected to being reduced further in size. On the other hand, the fine material that meets the desired size specifications is carried to a suitable collector for subsequent discharge. Lastly, the cleaned air is made to continuously return to the mill through an exhauster, the latter being suitably connected for this purpose in closed circuit relation with the mill.

A high degree of efficiency is capable of being achieved with the roller mill by virtue both of the fact that the pulverized, i.e., ground, material is removed from the grinding zone promptly and of the fact that the finished product is swept away with the airflow for collection. The result thus is that on the one hand a minimum of excessive fines are produced while on the other hand and concomitantly therewith maximum mill capacity and economy are also being realized.

Notwithstanding the fact that as has been discussed above prior art forms of roller mills have been advantageously characterized in certain respects insofar as concerns both the nature of the construction and the mode of operation thereof, there has nevertheless still existed a need to effect improvements with regard thereto. More specifically, there are several variables relating to the operation of a roller mill, which are known to affect the roller mill's output and/or the fineness of the pulverized material which is produced as a product from the roller mill. In this connection, attention is directed to the following list of variables: feed rate; mill speed; mill pressure drop, i.e., feed retention time in the mill; classifier setting in those instances wherein the roller mill is equipped with a classifier of the static type and classifier speed in those instances wherein the roller mill is equipped with a classifier of the dynamic type; and mill airflow.

Continuing, the aforedescribed variables are known to bear certain relationships one to another. Namely, mill output is known to increase as a direct function of feed rate, mill speed and airflow, and inversely as a function of classifier setting or classifier speed, i.e., higher fineness, depending on the type of classifier with which the roller mill is equipped. On the other hand, product fineness increases directly as a function of mill speed, pressure drop, classifier setting or classifier speed, depending on the type of classifier with which the roller mill is equipped, and inversely as a function of airflow.

The conventional practice heretofore has been to operate roller mills at a constant optimum mill speed, pressure drop and airflow. As such, it has been possible to produce from the roller mill an output having different product finenesses simply by effecting changes in the setting of the classifier or in the speed of the classifier as the case may be depending upon the type of classifier with which the roller mill is equipped. Further, to effect changes from the optimum in any of the other variables, i.e., mill speed, pressure drop or airflow has been found not to be feasible. Namely, it has been found that changing any of these other variables, i.e., mill speed, pressure drop or airflow, from the optimum usually results in a noisy, vibratory mill, which can ultimately cause mechanical failure of the roller mill. In summary, it can thus be seen that prior art forms of roller mills have been disadvantageously characterized in that such mills have proven to be in essence one capacity machines, i.e., machines possessing no turndown capability. This lack of turndown capability can be attributed largely to the fact that insofar as roller mills are concerned there exists a need for an adequate cushion to always be present of the material that is to be ground between the rolls and the grinding ring. Moreover, because of this lack of turndown capability which has served to characterize the operation of prior art forms of roller mills, there has existed a requirement for effecting the storage of the excess portion of the output of the roller mill until such time as a need therefor exists. On the other hand, the storage of ground material for any significant period of time is for a number of reasons acknowledged by those who are skilled in this art to be undesirable.

Attempts are known to have been made to provide a roller mill, which insofar as output capacity is concerned would have a turndown capability. Moreover, one such attempt forms the subject matter of U.S. Pat. No. 4,184,640. In accord with the teachings of the latter U.S. patent, it is proposed to provide a roller mill with a control system wherein the control system is connected in circuit relation with prime mover means, which in turn are connected to the grinding rolls and the classifier means, respectively, of the roller mill. With further reference to U.S. Pat. No. 4,184,640, as described therein the mode of operation of the control system is such that the latter is effective to vary the speed of the prime mover means that is connected to the grinding rolls as well as that of the prime mover means that is connected to the classifier means whereby the particle size, i.e., fineness, of the material being discharged from a roller mill equipped with the subject control system is maintained substantially uniform through adjustment of the centrifugal force that the grinding rolls exert inversely with the speed of the classifier means.

Although the control system which forms the subject matter of U.S. Pat. No. 4,184,640 is alleged, when cooperatively associated with a roller mill, to be operative to obviate the problem which heretofore has served to plague prior art forms of roller mills, i.e., the fact that prior art forms of roller mills did not possess any turndown capability insofar as output capacity is concerned, it has nevertheless served to introduce a new and different problem. Namely, it has been found that a characteristic of a roller mill equipped with a control system constructed in accordance with the teachings of U.S. Pat. No. 4,184,640 is that such a roller mill exhibits a susceptibility to being subjected either to a condition wherein the material to be ground in the roller mill is fed thereto at an excessive rate whereupon the roller mill can become plugged or to a condition wherein the material to be ground in the roller mill is fed thereto at an insufficient rate whereupon the mill can become underfed. The way in which this comes about is that should the demand for output from the roller mill change significantly the control system constructed in accordance with the teachings of U.S. Pat. No. 4,184,640 is designed to cause an appropriate change to occur both in the speed of the grinding rolls and in the speed of the classifier means. This in turn has the effect of producing a variation in the differential pressure measured relative to the roller mill. Further, as a consequence of the existence of this variation in the differential pressure, a change will be had in the rate at which the material to be ground in the roller mill is being fed thereto.

One can, thus, see that in accord with the mode of operation of the control system constructed in accordance with the teachings of U.S. Pat. No. 4,184,640, although a change in the demand for output of the roller mill occasions, relatively speaking, an immediate change in the speed of the grinding rolls and in the speed of the classifier means, it does not produce any such immediate change in the rate of feed of material to the roller mill until such time as the change in the speed of the grinding rolls and in the speed of the classifier means causes the differential pressure measured relative to the roller mill to vary. Moreover, it is only when this variation in differential pressure becomes measurable that the rate of feed of material to the roller mill is affected. Unfortunately, by the time this occurs, the rate of feed of material to the roller mill will continue at the same rate notwithstanding the fact that the demand for output from the roller mill may have diminished sharply or may have increased sharply which thereby in turn may in the case of the diminished demand cause the roller mill to become plugged by virtue of the fact that the rate of feed of material to the roller mill is being maintained at an excessive rate of feed as compared to that required to meet the diminished demand, or in the case of the increased demand may cause the roller mill to become underfed by virtue of the fact that the rate of feed of the material to the roller mill is being maintained at an insufficient rate of feed as compared to that required to meet the increased demand for output from the roller mill. Either of these two conditions, i.e., an overfeeding of the roller mill or an underfeeding of the roller mill, can cause the roller mill to suffer severe damage. Accordingly, it is desirable to provide a roller mill which embodies a mode of operation wherein both of these two conditions, i.e., an overfeeding and an underfeeding of the roller mill, are avoided.

A need has thus existed in the prior art for a new and improved control system with which a roller mill might be equipped, and which would function to control the mode of operation of the roller mill. Moreover, a need has been demonstrated for such a control system which when cooperatively associated with a roller mill would be operative to provide the roller mill with a turndown capability insofar as relates to the matter of the latter's output capacity. Finally, a need has been shown for such a control system which would prevent a roller mill equipped therewith from suffering from the same difficulties that have served to disadvantageously characterize the operation of roller mills that embody. either no control system for controlling the mode of operation thereof or a control system which may cause the roller mill to become overfed or underfed.

It is, therefore, an object of the present invention to provide a new and improved control system suitable for employment in cooperative association with a roller mill, and operative to effectuate control over the mode of operation of the roller mill so equipped therewith.

It is another object of the present invention to provide such a control system that is operative when cooperatively associated with a roller mill to provide the latter with a turndown capability insofar as concerns the output capacity thereof, i.e., to enable the roller mill to operate over a wide range of output capacities.

It is still another object of the present invention to provide such a control system that is operative when cooperatively associated with a roller mill to enable the latter to operate over a wide range of output capacities while yet permitting a constant product fineness to be maintained despite the fact that the roller mill may be required to operate at different rates of output capacity.

A further object of the present invention is to provide such a control system that is operative when cooperatively associated with a roller mill to enable the latter to operate over a wide range of output capacities while yet permitting a constant air-to-solids ratio to be maintained from the mill, within the restraints of air-to-solids conveying pipe velocities, despite the fact that the roller mill may be required to operate at different rates of output capacity.

A still further object of the present invention is to provide such a control system that is operative when cooperatively associated with a roller mill to enable the latter to operate over a wide range of output capacities in such a manner that there exists a feed forward capability. whereby changes in the rate of feed of material to the mill can be effected when the demand for output from the mill changes without in turn producing a condition which may cause either an overfeeding of the mill or an underfeeding of the mill.

Yet another object of the present invention is to provide such a control system which when cooperatively associated with a roller mill is operative to control the mode of operation of the roller mill, and which is characterized in that a different constant for product fineness and/or a different constant for the air-to-solids ratio may be selectively introduced into the control system in order to satisfy the need therefor arising out of the fact that there exists a requirement to operate the roller mill in accordance with different operating parameters such as those which by way of exemplification and not limitation might be occasioned by a change in the nature of the characteristics of the material that is to be ground in the roller mill.

Yet still another object of the present invention is to provide such a control system operative when cooperatively associated with a roller mill to control the mode of operation of the roller mill which is relatively simple to construct and employ, as well as being relatively inexpensive to provide.

SUMMARY OF THE INVENTION

In accordance with the present invention there is provided a control system that is operable to control the mode of operation of a roller mill. More specifically, the subject control system is operative to control the rate of feed of material to a roller mill in accordance with the output that is being demanded from the roller mill, while yet at the same time ensuring that during changes in the output being demanded from the roller mill both a constant fineness of pulverized material and a constant air-to-solids ratio from the roller mill are being maintained. Continuing, the subject control system includes, connected in circuit relation one with another, demand sensing means operative to sense the output being demanded from the roller mill, an airflow measuring means operative to measure the airflow through the roller mill, a pressure measuring means operative to measure the differential pressure across the roller mill, feed control means operative for controlling the rate at which the material to be ground in the roller mill is fed thereto, mill motor control means operative for controlling the speed of the mill motor, and classifier control means operative for controlling the mode of operation of the classifier. In accord with the mode of operation of the subject control system, a signal is generated by the demand sensing means when a change occurs in the demand for output from the roller mill. This signal in turn is fed in the form of an input to each of the following: the feed control means, the airflow measuring means and the pressure measuring means. When received thereby, this signal is operative to initiate changes, if they are required, in the rate at which the material is being fed to the roller mill, the amount of airflow through the roller mill in order to provide the desired air-to-solids ratio, and the differential pressure across the roller mill, respectively. The aforereferenced signal generated by the demand sensing means in addition is also fed in the form of an input to a feed forward circuit with which the subject control system in accordance with the present invention is preferably provided. The operation of this feed forward circuit is such that when the signal generated by the demand sensing means evidences the fact that a rapid change in demand per unit time is occurring the feed forward circuit is operative to anticipate and to modulate the speed of the mill motor as well as the operation of the classifier such that the roller mill is capable of meeting the changing feed rate at which material is being supplied to the roller mill without the mill being subjected to a condition wherein there occurs either an overfeeding of the mill or an underfeeding of the mill.

DESCRIPTION OF A PREFERRED EMBODIMENT

Figure 1:
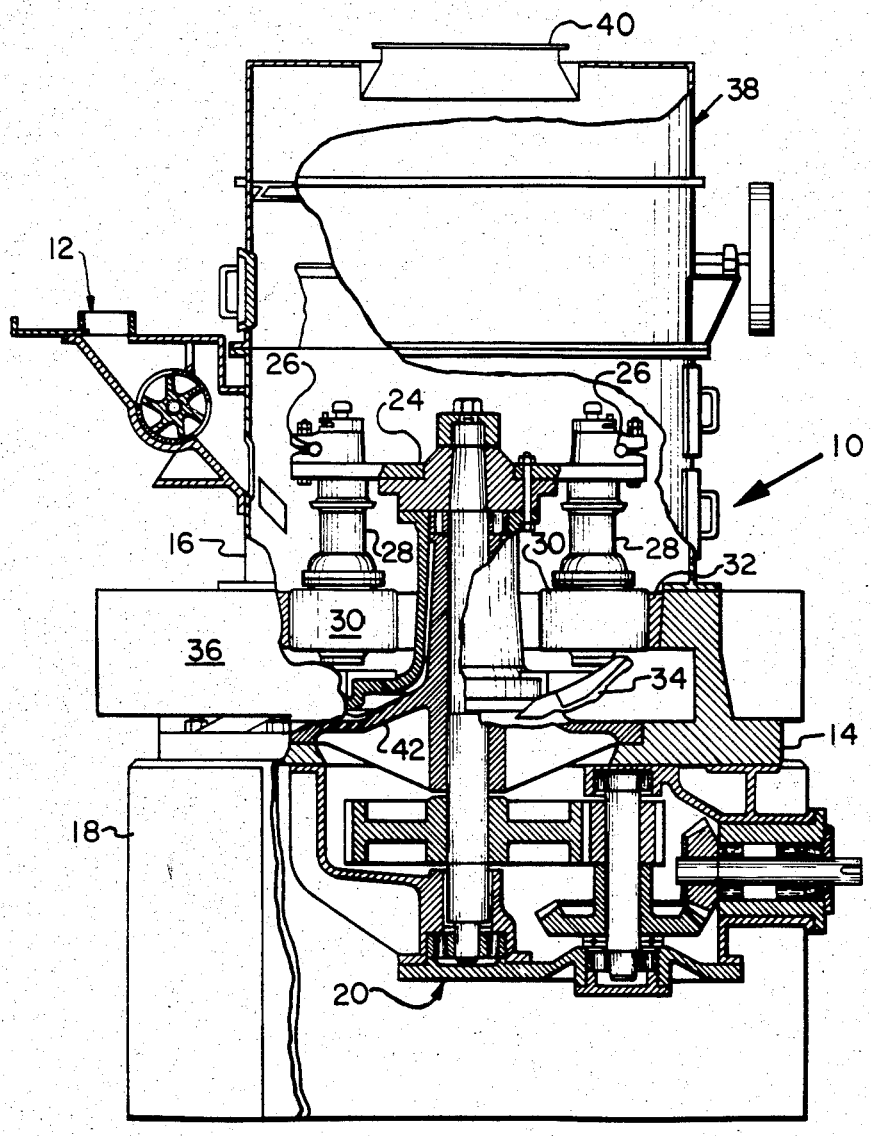
FIG. 1 is a side elevational view partly in section and with some parts broken away of a roller mill embodying a control system constructed in accordance with the present invention, and illustrated having feeder means cooperatively associated therewith.

Referring now to the drawing, and more particularly to FIG. 1 thereof, a roller mill, generally designated by reference numeral 10 is depicted therein with a feeder means, the latter being generally designated therein by reference numeral 12, illustrated cooperatively associated therewith. Inasmuch as the nature of the construction and the mode of operation of roller mills per se are well-known to those skilled in the art, it is not deemed necessary, therefore, to set forth herein a detailed description of the roller mill 10 illustrated in FIG. 1 of the drawing. Rather, it is deemed sufficient for purposes of obtaining an understanding of a roller mill 10, which is equipped with a control system constructed in accordance with the present invention, that there be presented herein merely a description of the nature of the construction and the mode of operation of the components of the roller mill 10 and the feeder means 12, with which the aforesaid control system cooperates. For a more detailed description of the nature of the construction and the mode of operation of the components of the roller mill 10, which are not described in depth herein, one may have reference to the prior art.

Referring further to FIG. 1 of the drawing, the roller mill 10 as illustrated therein includes a mill base 14 to which a mill side 16 is suitably affixed in known fashion. The mill base 14 with the mill side 16 affixed thereto is in turn preferably suitably supported upon a mill foundation, the latter being seen at 18 in FIG. 1. Continuing, suitably housed within the mill base 14 and extending upwardly into the mill side 16 is a gear means, the latter being denoted generally by the reference numeral 20 in FIG. 1. The gear means 20 is designed to operate in a conventional fashion. Namely, the gear means 20 is driven in known fashion by a mill motor, the latter being denoted in each of FIGS. 2 and 3 of the drawing by the reference numeral 22. Further reference will be had hereinafter to the mill motor 22 in connection with the description of the nature of the construction and the mode of operation of the control system with which the roller mill 10 is equipped in accordance with the present invention.

A spider 24 is suitably mounted at the upper end, as viewed with reference to FIG. 1 of the drawing, of the gear means 20 so as to be rotatable therewith. Moreover, the spider 24 has a plurality of trunnion bearing assemblies 26 cooperatively associated therewith in a suitable fashion for a purpose yet to be described. In accord with the illustration of the roller mill 10 that is to be found set forth in FIG. 1 of the drawing, two such trunnion bearing assemblies 26 are to be seen cooperatively associated with the spider 24. As seen with reference to FIG. 1, there is a journal assembly 28 associated with each of the trunnion bearing assemblies 26. Furthermore, on each of the journal assemblies 28 there is suitably mounted in known fashion a grinding roll 30. The grinding rolls 30 to which further reference will be had hereinafter comprise one of the grinding elements of the roller mill 10.

The other grinding element which the roller mill 10 embodies and which is designed to coact with the grinding rolls 30 so as to effectuate a pulverization of the material passing therebetween is the grinding ring 32. The grinding ring 32 which is essentially circular in configuration is suitably mounted through the use of conventional mounting means (not shown) within the mill base 14 of the roller mill 10 so as to be positioned in juxtaposed relation to the grinding rolls 30. Also, suitably mounted for rotation within the mill base 14 for a purpose yet to be described are a plurality of plow-like members 34, only one such plow-like member 34 being visible in FIG. 1. More specifically, the plow-like members 34 are cooperatively associated with the gear means 20 so as to be rotatable therewith.

Continuing with the description of the nature of the construction of the roller mill 10, the latter also includes a return air housing 36. The return air housing 36 is suitably located in juxtaposed relation to the mill base 14 of the roller mill 10 so as to provide a flow path for airflow between the interior and the exterior of the roller mill 10. For purposes of completing the description of the roller mill 10 depicted in FIG. 1 of the drawing, mention is made here of the classifier, generally denoted by the reference numeral 38, with which the roller mill 10 is suitably provided. Thus, as best understood with reference to FIG. 1 of the drawing, the classifier 38 is mounted in conventional fashion on the mill side 16 of the roller mill 10 so as to be coaxially aligned therewith. Further, in known fashion the classifier 38 is operative to effectuate a separation according to particle size of the material that has been ground within the roller mill 10 through the coaction of the grinding rolls 30 with the grinding ring 32. Finally, note is taken of the fact that the classifier 38 is suitably provided at the upper end thereof, as viewed with reference to FIG. 1, with an outlet, designated in FIG. 1 by means of the reference numeral 40.

In accord with the mode of operation of roller mills that embody the form of construction of the roller mill 10 depicted in FIG. 1 of the drawing, the material, which is to be pulverized, i.e., ground, therewithin, is introduced at a controlled rate by means of the feeder means denoted by the reference numeral 12 in FIG. 1 of the drawing, and falls to the mill bottom seen at 42 in FIG. 1. The plow-like members 34 set at an angle in front of each of the rolls 30 scoop up the material that is to be ground and deposit it in a continuous stream between the rolls 30 and the ring 32 whereby through the coaction of the latter rolls 30 and ring 32 the pulverization, i.e., grinding, of the material occurs. Continuing, a large volume of air enters the roller mill 10 through tangential ports with which the mill base 14 is provided for this purpose at points immediately below the grinding ring 32. This large volume of air is operative to sweep the fine and medium fine fractions of the now ground material into a separating zone located directly above the grinding elements 30 and 32. The classifier 38 then classifies the ground material whereby the oversize particles are made to automatically drop back to the grinding zone within the roller mill 10 whereupon they are subjected to further size reduction, i.e., further grinding. The fine particles of material, on the other hand, that are of the proper size are carried along in the airflow and are subsequently discharged from the roller mill 10. Moreover, once the fine particles of material have been separated from this air, the latter is made to return to the roller mill 10 whereupon it once again repeats its path of flow through the roller mill 10 carrying along with it once more the newly ground particles of material.

Figure 2:
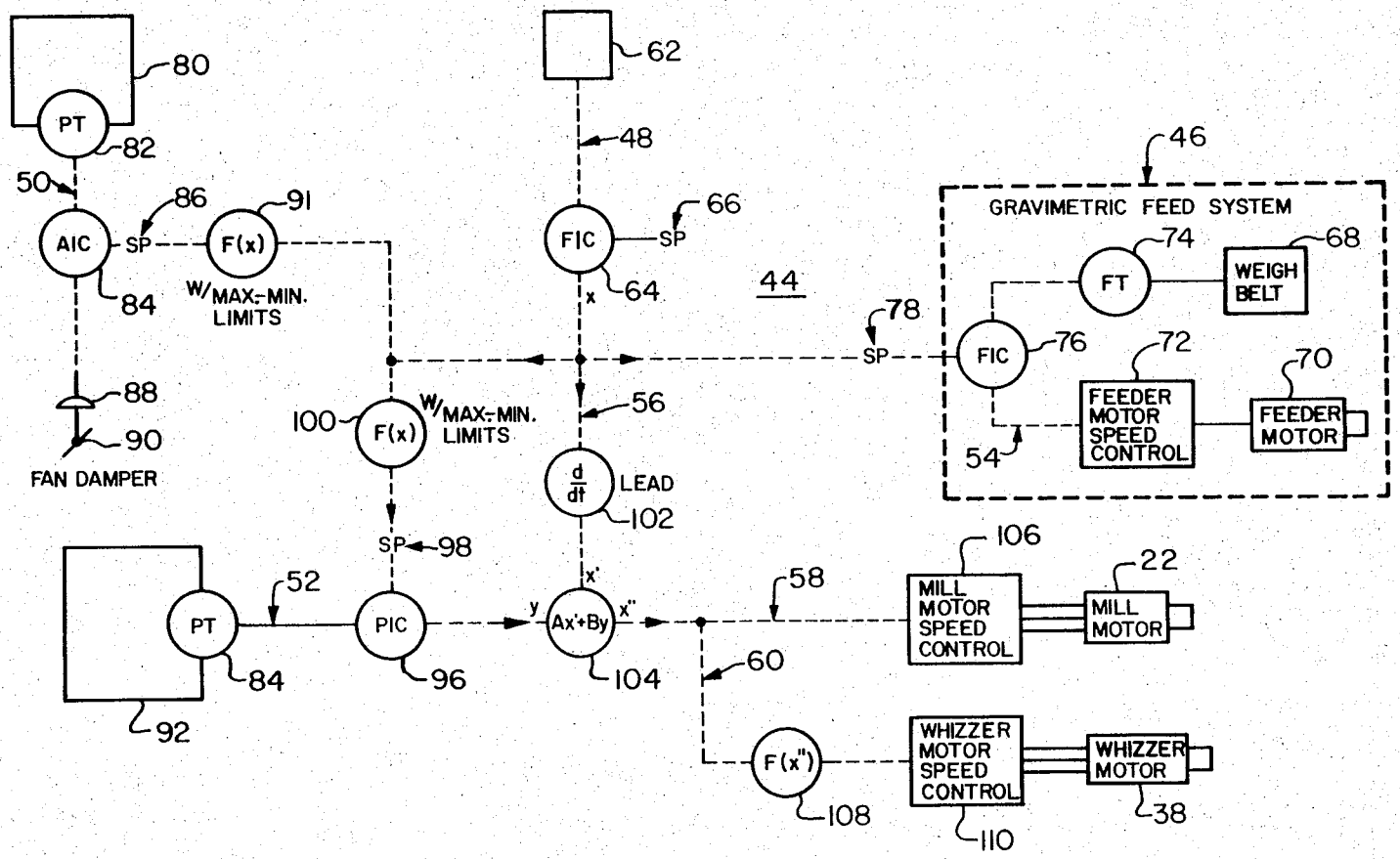
FIG. 2 is a schematic representation of a control system constructed in accordance with the present invention illustrated being employed with a roller mill that utilizes a gravimetric feed system to feed to the roller mill the material that is to be ground therewithin.
Figure 3:
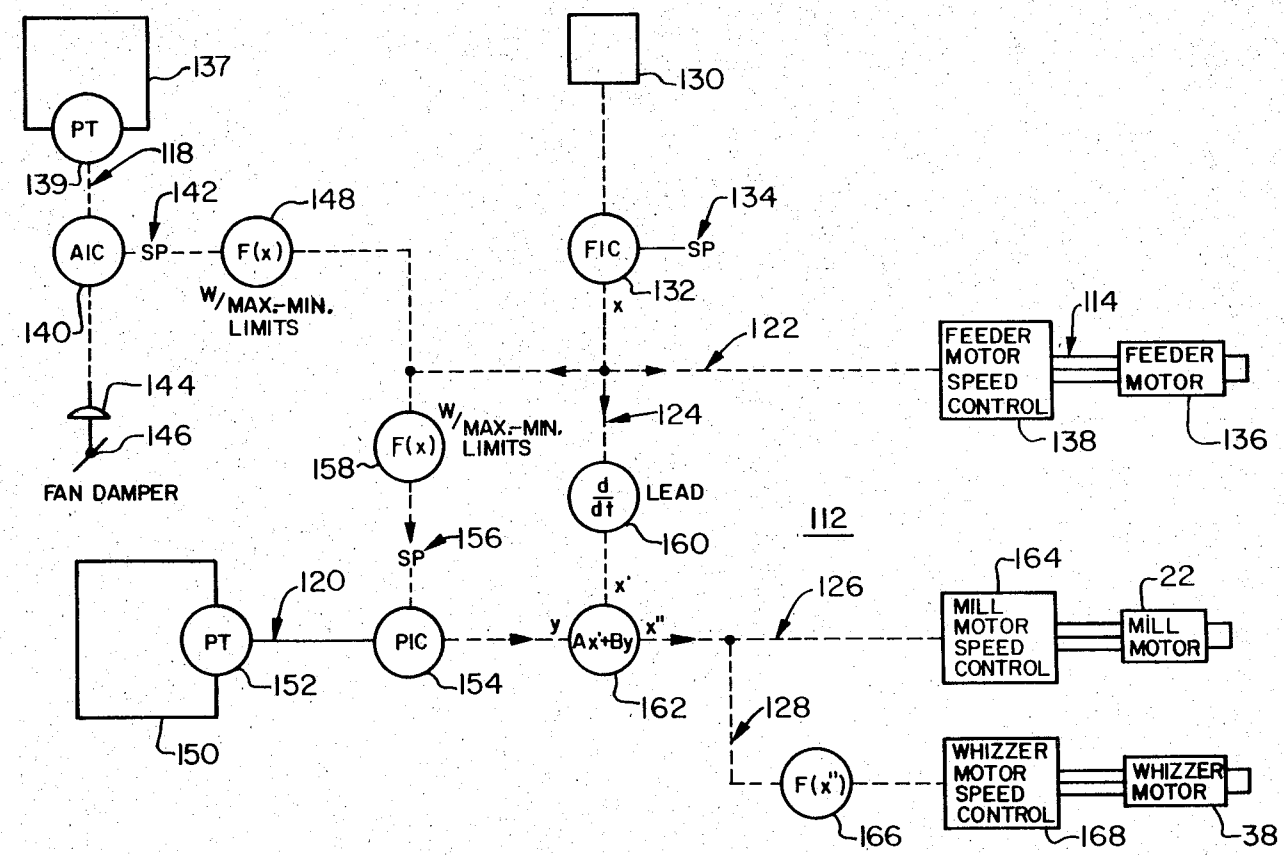
FIG. 3 is a schematic representation of a control system constructed in accordance with the present invention illustrated being employed with a roller mill that uses a volumetric feed system to feed to the roller mill the material that is to be ground therewithin.

Reference will now be had particularly to FIGS. 2 and 3 of the drawing for purposes of describing the control system, generally designated in FIG. 2 by reference numeral 44, with which in accordance with the present invention a roller mill constructed in the manner of the roller mill 10 of FIG. 1 is capable of being equipped. More specifically, in accord with the present invention, the control system 44 of FIG. 2 is operative for purposes of controlling the rate of feed of the material to be ground within the roller mill 10 in accordance with the output in the form of ground material being demanded from the roller mill 10, while yet ensuring that both the proper air-to-solids ratio and the desired degree of fineness of the ground material are being maintained and that the roller mill 10 exhibits no susceptibility to becoming either overfed or underfed as a consequence of the need to meet changing rates of feed of material to the roller mill 10. This is accomplished, as will be described more fully hereinafter by having the control system 44 of FIG. 2 exercise control over the feed system by which the material to be ground in the roller mill 10 is fed thereto, over the air-to-solids ratio that is associated with the operation of the roller mill 10, over the differential pressure that exists across the roller mill 10, over the speed at which the mill motor 22 of the roller mill 10 is operated, and over the operation of the classifier 38 in accord with the output that is being demanded from the roller mill 10.

With further reference to FIG. 2 of the drawing, there is illustrated therein a first embodiment of a control system, denoted in FIG. 2 by the reference numeral 44, constructed in accordance with the present invention. Embodying the construction as shown in FIG. 2, the control system 44 is designed to be employed to effectuate control over the mode of operation of a roller mill 10 with which a gravimetric feed system is utilized to feed to the roller mill 10 the material that is to be ground therewithin. In this connection, a gravimetric feed system has been schematically depicted in FIG. 2 of the drawing wherein it can be found being designated generally by the reference numeral 46.

Proceeding now with a description of the control system 44 constructed as depicted in FIG. 2 of the drawing, the control system 44 includes, connected in circuit relation one with another, demand sensing means, generally designated by the reference numeral 48, operative to sense the output being demanded from the roller mill 10; airflow measuring means, generally designated by the reference numeral 50, operative to measure the airflow through the roller mill; pressure measuring means, generally designated by the reference numeral 52, operative to measure the differential pressure across the roller mill 10; feed control means, generally designated by the reference numeral 54, operative for controlling the rate at which the material to be ground in the roller mill 10 is fed thereto; feed forward circuit means, generally designated by the reference numeral 56, operative when a rapid change in demand for output from the roller mill 10 per unit time occurs; mill motor control means, generally designated by the reference numeral 58, operative for controlling the speed of the mill motor 22; and classifier control means, generally designated by the reference numeral 60, operative for controlling the mode of operation of the classifier 38.

Focusing attention first on the demand sensing means 48, the latter is suitably connected in circuit relation along the path which the ground material traverses in being conveyed from the roller mill 10 to the component (not shown), which is designed to receive the ground material from the roller mill 10. To this end, the demand sensing means 48 may be connected in circuit relation anywhere along the path of conveyance of the ground material from the roller mill 10 to the component (not shown) that receives the ground material. The essential point here is that the demand sensing means 48 be suitably connected in circuit relation along the path of conveyance of the ground material such that it is possible for the demand sensing means 48 to sense the demand for output from the roller mill 10 and to provide a suitable signal in response thereto, which is representative of the amount of output that is being demanded from the roller mill 10. Any. conventional form of sensing means capable of functioning in the aforedescribed manner may be utilized for this purpose. Such a sensing means bearing the reference numeral 62 has been schematically depicted in FIG. 2 of the drawing. Upon being generated by the sensing means 62, the demand signal is fed as an input to a fuel indicating controller, the latter being designated in FIG. 2 by the reference numeral 64. A controller suitable for use for this purpose is commercially available from Taylor Instruments of Rochester, New York under the designation of "Mod 30" (Controller). In accord with the mode of operation of the fuel indicating controller 64 in the control system 44, the fuel indicating controller 64 utilizes a set point, schematically depicted at 66 in FIG. 2, which is designed to be manually set.

Reference will next be had broadly to the gravimetric feed system 46 as well as specifically to the feed control means 54. As best understood with reference to FIG. 2 of the drawing, the gravimetric feed system 46 includes a weigh belt, the latter being designated in FIG. 2 by the reference numeral 68, a feeder motor 70, and speed control means 72, the latter being operative for controlling the speed of the feeder motor 70. It should thus be readily apparent to those skilled in this art that the gravimetric feed system 46 to the extent described above and as illustrated in FIG. 2 is designed to be operative to feed to the roller mill 10 in known fashion the material that is to be ground therewithin. Continuing, in accord with the present invention the gravimetric feed system 46 has cooperatively associated therewith the feed control means 54 portion of the control system 44. That is, a feed transmitter seen at 74 in FIG. 2 is connected in circuit relation with the weigh belt 68 of the gravimetric feed system 46. In turn, the feed transmitter 74 is connected in circuit relation with a feed indicating controller, the latter being denoted by the reference numeral 76 in FIG. 2. The feed indicating controller 76 may take the form of a controller that is commercially available from Taylor Instruments of Rochester, N.Y. under the designation of "Mod 30" (Controller). Also, note is made here of the fact that the feed indicating controller 76 in accord with the mode of operation thereof in the control system 44 utilizes a set point, schematically depicted at 78 in FIG. 2, which is designed to be manually set. Finally, as shown in FIG. 2, the feed indicating controller, 76 is suitably connected in circuit relation with the fuel indicating controller 64 such that the output of the latter is received by the former in the form of an input.

The airflow measuring means 50 and the pressure measuring means 52 will next be considered in turn. Commencing first with the airflow measuring means 50, the latter includes a roller mill airflow sensor, which can be seen schematically depicted at 80 in FIG. 2 of the drawing. The roller mill airflow sensor 80 is designed to be suitably located within the air system of the roller mill 10 so as to be operative to produce in known fashion measurements of the airflow therethrough. In this regard, any suitable means of conventional construction capable of performing the aforedescribed function may be utilized for this purpose. Continuing, the roller mill airflow sensor 80 is connected in circuit relation with a pressure transmitter, the latter being denoted in FIG. 2 by the reference numeral 82. The pressure transmitter 82 in turn is connected in circuit relation with an airflow indicating controller that has been designated by the reference numeral 84 in FIG. 2. Suitable for use for this purpose is a controller, which is commercially available from Taylor Instruments of Rochester, N.Y. under the designation of "Mod 30" (Controller). For purposes of employment in the control system 44, the airflow indicating controller 84 utilizes a set point, seen schematically at 86 in FIG. 2, that is designed to be self-correcting. It can also be seen with reference to FIG. 2 of the drawing that the airflow indicating controller 84 is connected in circuit relation with a control linkage, designated therein by the reference numeral 88, which is cooperatively associated with a fan damper 90 such that the relative positioning of the latter is controlled by means of the control linkage 88 in response to signals provided thereto from the airflow indicating controller 84. In addition, as shown in FIG. 2 the airflow indicating controller 84 is connected in circuit relation with linearization means, denoted in FIG. 2 by the reference numeral 91, that is operative to effectuate in known fashion a linearization of the output from the fuel indicating controller 64 being supplied in the form of an input to the airflow indicating controller 84, which when received thereby is operative to effect, as needed, changes in the set point 86 with which the airflow indicating controller 84 as described previously hereinbefore is suitably provided. Any conventional form of linearization means capable of performing this function may be utilized for this purpose.

As regards the pressure measuring means 52, the latter includes a roller mill pressure sensor which can be found schematically depicted at 92 in FIG. 2 of the drawing. The roller mill pressure sensor means 92 is designed to be suitably located relative to the roller mill 10 so as to be operative to measure the differential pressure across the roller mill 10. For this purpose, the roller mill pressure sensor 92 may take the form of any known means of conventional construction suitable for use for this purpose. Continuing, the roller mill pressure sensor 92 is connected in circuit relation with a pressure transmitter, the latter being denoted in FIG. 2 by the reference numeral 94. The pressure transmitter 94 in turn is connected in circuit relation with a pressure indicating controller that has been designated by the reference numeral 96 in FIG. 2. A controller, which is suitable for use for this purpose, is commercially available from Taylor Instruments of Rochester, N.Y. under the designation of "Mod 30" (Controller). In accord with the mode of operation of the control system 44, the pressure indicating controller 96 as employed therein utilizes a set point, seen schematically at 98 in FIG. 2, that is designed to be self-correcting. It can also be seen with reference to FIG. 2 of the drawing that the pressure indicating controller 96 is connected in circuit relation with a linearization means, denoted in FIG. 2 of the drawing by the reference numeral 100, that is operative to effectuate in known fashion a linearization of the signal that the pressure indicating controller 96 is to receive in the form of an input, and which when received thereby is operative to effect, as needed, changes in the set point 98 with which the pressure indicating controller 96 as described previously hereinbefore is suitably provided. Any conventional form of linearization means capable of performing this function in known fashion may be utilized for this purpose.

Attention will now be focused on the feed forward circuit means 56 with which the control system 44 constructed in accordance with the present invention is suitably provided. The feed forward circuit means 56 is connected in circuit relation with the demand sensing means 48, which has been previously described hereinbefore. To this end, the feed forward circuit means 56 includes a differentiation means, which can be found schematically depicted at 102 in FIG. 2 of the drawing, and which is commercially available from Taylor Instruments of Rochester, N.Y. under the designation of "Mod 30" (Math Unit), and a summation means, depicted schematically at 104 in FIG. 2 of the drawing. In accord with the illustration of the control system 44 set forth in FIG. 2 of the drawing, the differentiation means 102 is suitably connected in circuit relation with the fuel indicating controller 64 of the demand sensing means 48 so as to receive in the form of an input the output from the fuel indicating controller 64. Moreover, it is to be understood that any known form of differentiation means and summation means of conventional construction other than those which are commercially available from Taylor Instruments of Rochester, N.Y. under the "Mod 30" (Math unit) and the "Mod 30" (Controller) designation, respectively, and which are suitable for employment to effectuate a differentiation of the signal provided in the form of an output from the fuel indicating controller 64 and to effectuate a summation of that signal which is provided as an output from the pressure indicating controller 96 with that signal which is provided as an output from the fuel indicating controller 64 after the latter signal has been subjected to differentiation, may be utilized in the feed forward circuit means 56 of the control system 44 as the differentiation means 102 and the summation means 104, respectively, without departing from the essence of the invention.

To complete the description of the control system 44 constructed as illustrated in FIG. 2 of the drawing, a description will now in turn be had of the mill motor control means 58 and the classifier control means 60. Considering first the mill motor control means 58, the latter encompasses a mill motor speed control means, schematically depicted at 106 in FIG. 2 of the drawing, which is suitably connected in circuit relation with the mill motor 22 that as previously described hereinbefore drives the gear means 20 such that the mill motor speed control means 106 is operative to effect control over the operation of the mill motor 22 and thereby the gear means 20. To this end, the mill motor control means 106 may take the form of any control means of conventional construction that is suitable for employment for this purpose.

Turning next to a consideration of the classifier control means 60, the latter includes a linearization means, seen schematically at 108 in FIG. 2 of the drawing, which is suitably connected in circuit relation with a classifier motor speed control means, depicted at 110 schematically in FIG. 2 of the drawing. For purposes of this description it is to be understood that the roller mill 10 is assumed to embody a classifier of the dynamic type. Continuing, the classifier motor speed control means 110 is connected in circuit relation with the classifier 38 so as to effectuate control of the operation of the latter. In this regard, both the linearization means 108 and the classifier motor speed control means 110 may take the form of any suitable means of conventional construction that is known in the prior art as being suitable for employment in the aforedescribed fashion.

A description will now be had of the mode of operation of the control system 44 constructed as illustrated in FIG. 2 of the drawing. In accordance therewith, a signal is generated by the demand sensing means 48 when a change occurs in the demand for output from the roller mill 10. This signal in turn is fed in the form of an input to each of the following: the feed control means 54, the airflow measuring means 50 and the pressure measuring means 52. When received thereby, this signal is operative to cause changes to be initiated, if they are required, in the rate at which the material is being fed to the roller mill 10, the amount of airflow through the roller mill 10 in order to provide the proper air-to-solids ratio, and the differential pressure across the roller mill 10, respectively. The aforereferenced signal generated by the demand sensing means 48 in addition is also fed in the form of an input to the feed forward circuit means 56 which is operative such that when the signal generated by the demand sensing means 48 evidences the fact that a rapid change in demand per unit time is occurring the feed forward circuit means 56 is effective to anticipate and to modulate the speed of the mill motor 22 as well as the operation of the classifier 38 whereby the roller mill 10 is capable of meeting the changing feed rate at which material is being supplied to the roller mill 10 without the roller mill 10 being subjected to a condition wherein there occurs either an overfeeding of the roller mill 10 or an underfeeding of the roller mill 10. It is of course to be understood that when d/dt equals zero the operation of both the mill motor 22 and the classifier 38 will be responsive to differential pressure as determined by the pressure measuring means 52. Such a condition wherein d/dt equals zero will exist either when the change in demand per unit time sensed by the demand sensing means 48 is not sufficient to trigger the operation of the feed forward circuit means 56, or if the change in demand per unit time sensed by the demand sensing means 48 is sufficient to trigger the operation of the feed forward circuit means 56 when the performance by the feed forward circuit means 56 of the anticipation and modulation functions described hereinbefore has been completed thereby.

Reference will now be had to FIG. 3 of the drawing wherein there is illustrated a second embodiment of the control system, denoted in FIG. 3 by the reference numeral 112, constructed in accordance with the present invention. Embodying the construction as shown in FIG. 3, the control system 112 is designed to be employed to effectuate control over the mode of operation of a roller mill 10 with which a volumetric feed system is utilized to feed to the roller mill 10 the material that is to be ground therewithin. In this connection, a volumetric feed system has been schematically depicted in FIG. 3 of the drawing wherein it can be found being designated generally by the reference numeral 114.

Proceeding now with a description of the control system 112 constructed as depicted in FIG. 3 of the drawing, the control system 112 includes connected in circuit relation one with another, demand sensing means, generally designated by the reference numeral 116, operative to sense the output being demanded from the roller mill 10; airflow measuring means, generally designated by the reference numeral 118, operative to measure the airflow through the roller mill 10; pressure measuring means, generally designated by the reference numeral 120, operative to measure the differential pressure across the roller mill 10; feed control means, generally designated by the reference numeral 122, operative for controlling the rate at which the material to be ground in the roller mill 10 is fed thereto; feed forward circuit means, generally designated by the reference numeral 124, operative when a rapid change in demand for output from the roller mill 10 per unit time occurs; mill motor control means, generally designated by the reference numeral 126, operative for controlling the speed of the mill motor 22; and classifier control means, generally designated by the reference numeral 128, operative for controlling the mode of operation of the classifier 38.

Focusing attention first on the demand sensing means 116, the latter is suitably connected in circuit relation along the path which the ground material traverses in being conveyed from the roller mill 10 to the component (not shown), which is designed to receive the ground material from the roller mill 10. To this end, the demand sensing means 116 may be connected in circuit relation anywhere along the path of conveyance of the ground material from the roller mill 10 to the component (not shown) that receives the ground material. The essential point to be recognized here is that the demand sensing means 116 be suitably connected in circuit relation along the path of conveyance of the ground material such that it is possible for the demand sensing means 116 to sense the demand for output from the roller mill 10 and to provide a suitable signal in response thereto, which is representative of the amount of output that is being demanded from the roller mill 10. Any conventional form of sensing means capable of functioning in the aforedescribed manner may be utilized for this purpose. Such a sensing means bearing the reference numeral 130 has been schematically depicted in FIG. 3 of the drawing. Upon being generated by the sensing means 130, the demand signal is fed as an input to a fuel indicating controller, the latter being designated in FIG. 3 by the reference numeral 132. A controller suitable for use for this purpose is commercially available from Taylor Instruments of Rochester, N.Y. under the designation of "Mod 30" (Controller). In accord with the mode of operation of the fuel indicating controller 132 in the control system 112, the fuel indicating controller 132 utilizes a set point, schematically depicted at 134 in FIG. 3, which is designed to be manually set.

Reference will next be had to the manner in which the volumetric feed system 114 and the feed control means 122 interrelate one to another. To this end, as best understood with reference to FIG. 3 of the drawing, the volumetric feed system 114 includes feeder means, the latter being designated in FIG. 3 of the drawing by reference numeral 136, which is operative to supply to the roller mill 10 the material that is to be ground therewithin. Connected in circuit relation with the feeder means 136 is a feeder motor speed control means, which is identified in FIG. 3 by means of the reference numeral 138 and which is operative to control the speed of the motor of the feeder means 136. It should thus be readily apparent to those skilled in this art that the volumetric feed system 114 to the extent described above and as illustrated in FIG. 3 is designed to be operative to feed to the roller mill 10 in known fashion the material that is to be ground therewithin. Continuing, in accord with the present invention the volumetric feed system 114 has cooperatively associated therewith the feed control means 122 portion of the control system 112. That is, the feed control means 122 serves to interconnect the volumetric feed system 114 with the demand sensing means 116 portion of the control system 112 such that the output of the fuel indicating controller 132 is received by the feeder motor speed control means 138 in the form of an input.

The airflow measuring means 118 and the pressure measuring means 120 will next be considered in turn. Commencing first with the airflow measuring means 118, the latter includes a roller mill airflow sensor, which can be seen schematically depicted at 137 in FIG. 3 of the drawing. The roller mill airflow sensor 137 is designed to be suitably located within the air system of the roller mill 10 so as to be operative to produce in known fashion measurements of the airflow therethrough. In this regard, any suitable means of conventional construction capable of performing the aforedescribed function may be utilized for this purpose. Continuing, the roller mill airflow sensor 137 is connected in circuit relation with a pressure transmitter, the latter being denoted in FIG. 3 by the reference numeral 139. The pressure transmitter 139 in turn is connected in circuit relation with an airflow indicating controller that has been designated by the reference numeral 140 in FIG. 3. Suitable for use for this purpose is a controller, which is commercially available from Taylor Instruments of Rochester, New York under the designation of "Mod 30" (Controller). For purposes of employment in the control system 112, the airflow indicating controller 140 utilizes a set point, seen schematically at 142 in FIG. 3, that is designed to be self-correcting. It can also be seen with reference to FIG. 3 of the drawing that the airflow indicating controller 140 is connected in circuit relation with a control linkage, designated therein by the reference numeral 144, which is cooperatively associated with a fan damper 146 such that the relative positioning of the latter is controlled by means of the control linkage 144 in response to signals provided thereto from the airflow indicating controller 140. In addition, as shown in FIG. 3 the airflow indicating controller 140 is connected in circuit relation with linearization means, denoted in FIG. 3 by the reference numeral 148, that is operative to effectuate in known fashion a linearization of the output from the fuel indicating controller 132 being supplied in the form of an input to the airflow indicating controller 140, which when received thereby is operative to effect, as needed, changes in the set point 142 with which the airflow indicating controller 140 as described previously hereinbefore is suitably provided. Any conventional form of linearization means capable of performing this function may be utilized for this purpose.

As regards the pressure measuring means 120, the latter includes a roller mill pressure sensor, which can be found schematically depicted at 150 in FIG. 3 of the drawing. The roller mill pressure sensor 150 is designed to be suitably located relative to the roller mill 10 so as to be operative to measure the differential pressure across the roller mill 10. For this purpose, the roller mill pressure sensor 150 may take the form of any known means of conventional construction suitable for use for this purpose. Continuing, the roller mill pressure sensor 150 is connected in circuit relation with a pressure transmitter, the latter being denoted in FIG. 3 by the reference numeral 152. The pressure transmitter 152 in turn is connected in circuit relation with a pressure indicating controller that has been designated by the reference numeral 154 in FIG. 3. A controller, which is suitable for use for this purpose, is commercially available from Taylor Instruments of Rochester, N.Y. under the designation of "Mod 30" (Controller). In accord with the mode of operation of the control system 112, the pressure indicating controller 154 as employed therein utilizes a set point, seen schematically at 156 in FIG. 3, that is designed to be self-correcting. It can also be seen with reference to FIG. 3 of the drawing that the pressure indicating controller 154 is connected in circuit relation with a linearization means, denoted in FIG. 3 of the drawing by the reference numeral 158, that is operative to effectuate in known fashion a linearization of the signal that the pressure indicating controller 154 is to receive in the form of an input, and which when received thereby is operative to effect, as needed, changes in the set point 156 with which the pressure indicating controller 154 as described previously hereinbefore is suitably provided. Any conventional form of linearization means capable of performing this function in known fashion may be utilized for this purpose.

Attention will now be focused on the feed forward circuit means 124 with which the control system 112 constructed in accordance with the present invention is suitably provided. The feed forward circuit means 124 is connected in circuit relation with the demand sensing means 116, which has been previously described hereinbefore. To this end, the feed forward circuit means 124 includes a differentiation means, which can be found schematically depicted at 160 in FIG. 3 of the drawing, and which is commercially available from Taylor Instruments of Rochester, N.Y. under the designation of "Mod 30" (Math Unit), and a summation means, depicted schematically at 162 in FIG. 3 of the drawing. In accord with the illustration of the control system 112 set forth in FIG. 3 of the drawing, the differentiation means 160 is suitably connected in circuit relation with the fuel indicating controller 132 of the demand sensing means 116 so as to receive in the form of an input the output from the fuel indicating controller 132. Moreover, it is to be understood that any known form of differentiation means and summation means of conventional construction other than those which are commercially available from Taylor Instruments of Rochester, N.Y. under the "MOD 30" (Math unit) and the "MOD 30" (Controller) designation, respectively, and which are suitable for employment to effectuate a differentiation of the signal provided in the form of an output from the fuel indicating controller 132 and to effectuate a summation of that signal which is provided as an output from the pressure indicating controller 154 with that signal which is provided as an output from the fuel indicating controller 132 after the latter signal has been subjected to differentiation, may be utilized in the feed forward circuit 124 of the control system 112 as the differentiation means 160 and the summation means 162, respectively, without departing from the essence of the present invention.

To complete the description of the control system 112 constructed as illustrated in FIG. 3 of the drawing, a description will now in turn be had of the mill motor control means 126 and the classifier control means 128. Considering first the mill motor control means 126, the latter encompasses a mill motor speed control means, schematically depicted at 164 in FIG. 3 of the drawing, which is suitably connected in circuit relation with the mill motor 22 that as previously described hereinbefore drives the gear means 20 such that the mill motor speed control means 164 is operative to effect control over the operation of the mill motor 22 and thereby the gear means 20. To this end, the mill motor control means 126 may take the form of any control means of conventional construction that is suitable for employment for this purpose.

Turning next to a consideration of the classifier control means 128, the latter includes a linearization means, seen schematically at 166 in FIG. 3 of the drawing, which is suitably connected in circuit relation with a classifier motor speed control means, depicted at 168 schematically in FIG. 3 of the drawing. For purposes of this description it is to be understood that the roller mill 10 is assumed to embody a classifier of the dynamic type. Continuing, the classifier motor speed control means 168 is connected in circuit relation with the classifier 38 so as to effectuate control over the operation of the latter. In this regard, both the linearization means 166 and the classifier motor speed control means 168 may take the form of any suitable means of conventional construction that is known in the prior art as being suitable for employment in the aforedescribed fashion.

A description will now be had of the mode of operation of the control system 112 constructed as illustrated in FIG. 3 of the drawing. In accordance therewith, a signal is generated by the demand sensing means 116 when a change occurs in the demand for output from the roller mill 10. This signal in turn is fed in the form of an input to each of the following: the feed control means 122, the airflow measuring means 118 and the pressure measuring means 120. When received thereby, this signal is operative to cause changes to be initiated, if they are required, in the rate at which the material is being fed to the roller mill 10, the amount of airflow through the roller mill 10 in order to provide the proper air-to-solids ratio, and the differential pressure across the roller mill 10, respectively. The aforereferenced signal generated by the demand sensing means 116 in addition is also fed in the form of an input to the feed forward circuit means 124 which is operative such that when the signal generated by the demand sensing means 116 evidences the fact that a rapid change in demand per unit time is occurring the feed forward circuit means 124 is effective to anticipate and to modulate the speed of the mill motor 22 as well as the operation of the classifier 38 whereby the roller mill 10 is capable of meeting the changing feed rate at which material is being supplied to the roller mill 10 without the roller mill 10 being subjected to a condition wherein there occurs either an overfeeding of the roller mill 10 or underfeeding of the roller mill 10. It is of course to be understood that when d/dt equals zero the operation of both the mill motor 22 and the classifier 38 will be responsive to differential pressure as determined by the pressure measuring means 120. Such a condition wherein d/dt equals zero will exist either when the change in demand per unit time sensed by the demand sensing means 116 is not sufficient to trigger the operation of the feed forward circuit means 124, or if the change in demand per unit time sensed by the demand sensing means 116 is sufficient to trigger the operation of the feed forward circuit means 124 when the performance by the feed forward circuit means 124 of the anticipation and modulation functions described hereinbefore has been completed thereby.

In conclusion, reference is made here to yet another feature which serves to advantageously characterize a control system constructed in accordance with the present invention. This feature resides in the fact that the various controllers, which the control system 44 of FIG. 2 and the control system 112 of FIG. 3 each embody, are constructed such as to enable adjustments to be made thereto without requiring removal thereof from the control system in which they are being utilized. The significance of this is that it enables different constants to be selectively introduced into the control systems 44 and 112, respectively, should the need therefor arise. One such need, by way of exemplification and not limitation, might be occasioned for instance by the need to operate the roller mill 10, which is equipped with a control system constructed in the manner of the control system 44 illustrated in FIG. 2 or in the manner of the control system 112 illustrated in FIG. 3, in accordance with different operating parameters such as those that might be required by a change in the nature of the characteristics of the material that is to be ground in the roller mill 10.

Thus, in accordance with the present invention there has been provided a new and improved control system suitable for employment in cooperative association with a roller mill, and operative to effectuate control over the mode of operation of the roller mill so equipped therewith. Moreover, the subject control system of the present invention is operative when cooperatively associated with a roller mill to provide the latter with a turndown capability insofar as concerns the output capacity thereof, i.e., to enable the roller mill to operate over a wide range of output capacities. In addition, in accord with the present invention such a control system is provided that is operative when cooperatively associated with a roller mill to enable the latter to operate over a wide range of output capacities while yet permitting a constant product fineness to be maintained despite the fact that the roller mill may be required to operate at different rates of output capacity. Further, the subject control system of the present invention is operative when cooperatively associated with a roller mill to enable the latter to operate over a wide range of output capacities while yet permitting a constant air-to-solids ratio to be maintained from the mill, within the restraints of air-to-solids conveying pipe velocities, despite the fact that the roller mill may be required to operate at different rates of output capacity. Additionally, in accordance with the present invention such a control system is provided that is operative when cooperatively associated with a roller mill to enable the latter to operate over a wide range of output capacities in such a manner that there exists a feed forward capability whereby changes in the rate of feed of material to the mill can be effected when the demand for output from the mill changes without in turn producing a condition which may cause either an overfeeding of the mill or an underfeeding of the mill. Also, the subject control system of the present invention when cooperatively associated with a roller mill is operative to control the mode of operation of the roller mill, and is characterized in that a different constant for product fineness and/or a different constant for the air-to-solids ratio may be selectively introduced into the control system in order to satisfy the need therefor arising out of the fact that there exists a requirement to operate the roller mill in accordance with different operating parameters such as those which by way of exemplification and not limitation might be occasioned by a change in the nature of the characteristics of the material that is to be ground in the roller mill. Furthermore, in accord with the present invention such a control system is provided which when cooperatively associated with a roller mill to control the mode of operation of the roller mill is relatively simple to construct and employ, as well as being relatively inexpensive to provide.

While two embodiments of our invention have been shown, it will be appreciated that modifications thereof, some of which have been alluded to hereinabove, may still be readily made thereto by those skilled in the art. We, therefore, intend by the appended claims to cover the modifications alluded to herein as well as all the other modifications, which fall within the true spirit and scope of our invention.

What is claimed is:

1. In the combination of a roller mill operative for grinding materail therewithin and feeder means operative for feeding to the roller mill the material to be ground therewithin, the roller mill including a mill motor for driving the roller mill and a classifier for classifying material ground in the roller mill, the improvement comprising a control system for effecting control over the rate of feed of material to the roller mill in accordance with the rate of output of ground material being demanded from the roller mill, said control system comprising: to the a. demand sensing means mounted in juxtaposed relation to the path of flow of ground material being discharged from the roller mill in the form of output therefrom, said demand sensing means including sensing means and a fuel indicating controller connected in circuit relation wilh said sensing means and having a manually set set point, said sensing means being operative to sense the output of ground material being demanded from the roller mill, said fuel indicating controller being operative to generate a signal representative of the output of ground material being demanded from the roller mill as sensed by said sensing means;

b. feed control means operative for controlling the rate of feed of material to the roller mill, said feed control means being connected in circuit relation with said demand sensing means for receiving said signal from said fuel indicating controller, said feed control means in response to said signal received thereby from said fuel indicating controller being operative to effectuate any changes in the rate of feed of material to the roller mill that may be required in order to conform the rate of feed of material to the roller mill to the rate of output of ground material being demanded from the roller mill as changes occur in the rate of output of ground material being demanded from the roller mill;

c. airflow measuring means operative to measure the airflow through the roller mill, said airflow measuring means including interconnected in circuit relation one with another a roller mill airflow sensor and a pressure transmitter and an airflow indicating controller having a self-corrected set point and a control linkage and a fan damper and linearization means, said airflow measuring means being connected in circuit relation with said demand sensing means for receiving said signal from said fuel indicating controller, said airflow measuring means in response to said signal received thereby from said fuel indicating controller being operative through the manipulation of said control linkage and said fan damper to effectuate as established by said airflow indicating controller any changes in the amount of airflow through the roller mill that may be required in order to maintain the desired air-to-solids ratio in the roller mill as changes occur in the rate of output of ground material being demanded from the roller mill that result in changes being made by said feed control means in the rate of feed of material to the roller mill;

d. pressure measuring means operative to measure the differential pressure across the roller mill, said pressure measuring means including interconnected in circuit relation one with another a roller mill pressure sensor and a pressure transmitter and a pressure indicating controller having a self-correcting set point and linearization means, said pressure measuring means being connected in circuit relation with said demand sensing means for receiving said signal from said fuel indicating controller, said pressure measuring means in response to said signal received thereby from said fuel indicating controller being operative to effectuate as established by said pressure indicating controller any changes in the value of the differential pressure across the roller mill that may be required in order to maintain the desired differential pressure across the roller mill as changes occur in the rate of output of ground material being demanded frmom the roller mill;

e. mill motor control means operative for controlling the speed of the mill motor;

f. classifier control means operative for controlling the mode of operation of the classifier; and g. feed forward circuit means including differentiation means and summation means, said feed forward circuit means being connected in circuit relation with said mill motor control means and said classifier control means such that said summation means is connected in circuit relation with both said mill motor control means and said classifier control means and said differentiation means is connected in circuit relation with said summation means and therethrough to said mill motor control means and said classifier control means, said feed forward circuit means further being connected in circuit relation with said demand sensing means for receiving said signal from said fuel indicating controller, said feed forward circuit means being operative when said signal evidences the occurrence of a rapid change in demand per unit time of the output of ground material beind demanded from the roller mill to effectuate as established by said differentiation means and said summation means an anticipation and modulation of the speed of the mill motor as well as the operation of the classifier to prevent the roller mill from being subjected to a condition wherein there occurs either an overfeeding of the roller mill or an underfeeding of the roller mill relative to the rate of feed of material to the roller mill that is required in order to conform the rate of feed of material to the roller mill to the rate of output of ground material being demanded from the roller mill.

2. In the combination as set forth in claim 1 wherein said feed control means includes a feed transmitter and a feed indicating controller having a manually set set point, said feed control means being connected in circuit relation with a gravimetric feed system that includes a weigh belt, a feeder motor and a feeder motor speed control means such that said feed transmitter of said feed control means is connected in circuit relation with said weigh belt and said feed indicating controller is connected in circuit relation with said feed transmitter and therethrough to said weigh belt and with said feeder motor speed control means and therethrough to said feeder motor.

3. In the combination as set forth in claim 1 wherein said feed control means is connected in circuit relation with a volumetric feed system that includes a feeder motor and a feeder motor speed control means.

4. In the combination as set forth in claim 1 wherein said mill motor control means includes a mill motor speed control means connected in circuit relation with the mill motor.

5. In the combination as set forth in claim 1 wherein said classifier control means includes linearization means and classifier motor speed control means, said classifier control means being connected in circuit relation with the classifier such that said classifier motor speed control means is connected in circuit relation with the classifier and said linearization means is connected in circuit relation with said classifier motor speed control means and therethrough to the classifier.

6. In the combination as set forth in claim 1 wherein said control system further includes means for selectively introducing new constants into said control system.

* * * * *

REEXAMINATION CERTIFICATE (969th)

United States Patent [19] [11] B1 4,640,464

Musto et al. [45] Certificate Issued Dec. 20, 1988

[54] ROLLER MILL CONTROL SYSTEM

[75] Inventors: Richard L. Musto, Homewood; Mark R. Dunn, Wilmette, both of Ill.

[73] Assignee: Combustion Engineering, Inc., Windsor, Conn.

Reexamination Request:

No. 90/001,236, May 8, 1987

Reexamination Certificate for:

Patent No.: 4,640,464
Issued: Feb. 3, 1987
Appl. No.: 669,145
Filed: Nov. 7, 1984

[51] Int. Cl.[4] ..... B02C 25/00
[52] U.S. Cl. ..... 241/34; 241/36; 241/119; 241/130
[58] Field of Search ..... 241/34, 30, 36, 117-121, 241/129, 130

[56] References Cited

U.S. PATENT DOCUMENTS

| | | | |
|---|---|---|---|
| 2,172,317 | 9/1939 | Dickey | 241/35 |
| 4,184,640 | 1/1980 | Williams | 241/34 |
| 4,225,091 | 9/1980 | Steier | 241/24 |
| 4,478,371 | 10/1984 | Williams | 241/18 |
| 4,602,744 | 7/1986 | Williams | 241/30 |

OTHER PUBLICATIONS

Power, Sep. 1982, pp. 1-16 Special Report, Combustion Control and Burner Management by Paul S. Baur, Assistant Editor.
Programmable Controller Has PID Capability, Power, 3-1982.
TOSDIC 211-1, One Loop Controller, Toshiba.

*Primary Examiner*—Mark Rosenbaum

[57] ABSTRACT

A control system (44, 112) particularly adapted to be cooperatively associated with a mill (10) and in particular a roller mill (10) of the type that is operative to effectuate the grinding and/or pulverization of solid materials. When so employed, the subject control system (44, 112) enables the roller mill (10) to be operated over a wide range of varying levels of output of pulverized material, while yet ensuring that both the proper air/solids ratio and the desired degree of fineness of the pulverized material are being maintained. To achieve this result, the subject control system (44, 112) is operatively connected in circuit relation with the feed means (12) that supplies to the roller mill (10) the material that is to be pulverized therein, with the drive means (20, 22) through which the mill (10) is driven, with the classifier means (38) that effects a separation of the pulverized material according to fineness, and with the means which receives the output from the roller mill (10).

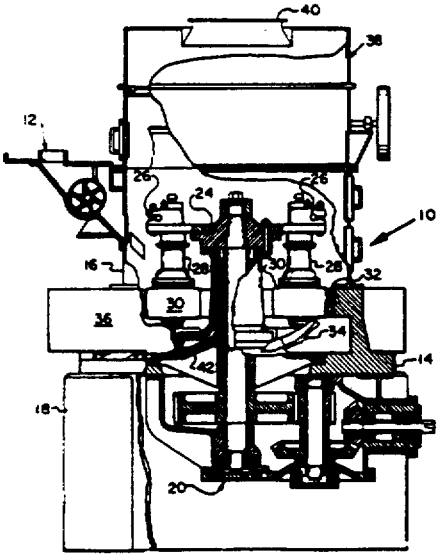

REEXAMINATION CERTIFICATE ISSUED UNDER 35 U.S.C. 307

THE PATENT IS HEREBY AMENDED AS INDICATED BELOW.

AS A RESULT OF REEXAMINATION, IT HAS BEEN DETERMINED THAT:

Claims 1–6 are cancelled.

* * * * *